US007954263B2

(12) United States Patent
Männikkö

(10) Patent No.: US 7,954,263 B2
(45) Date of Patent: Jun. 7, 2011

(54) SCREENING, CRUSHING OR MIXING BUCKET

(75) Inventor: Ari Männikkö, Nastola (FI)

(73) Assignee: Allu Finland Oy, Orimattila (FI)

( * ) Notice: Subject to any disclaimer, the term of this patent is extended or adjusted under 35 U.S.C. 154(b) by 0 days.

(21) Appl. No.: 12/648,735

(22) Filed: Dec. 29, 2009

(65) Prior Publication Data

US 2010/0162592 A1 Jul. 1, 2010

(30) Foreign Application Priority Data

Dec. 30, 2008 (FI) ..... 20086249

(51) Int. Cl.
*E02F 3/40* (2006.01)
*E02F 3/96* (2006.01)

(52) U.S. Cl. ..... 37/403; 241/157

(58) Field of Classification Search ..... 37/466, 37/444, 445, 403, 901, 903, 407, 408, 349; 241/101.72, 189.1, 236, 190, 191, 101.742, 241/605, 157; 171/63
See application file for complete search history.

(56) References Cited

U.S. PATENT DOCUMENTS

| | | | | |
|---|---|---|---|---|
| 5,405,092 | A * | 4/1995 | Jonninen | 241/27 |
| 5,619,811 | A * | 4/1997 | Yrjola | 37/466 |
| 5,887,810 | A * | 3/1999 | Maruyama | 241/189.1 |
| 6,220,445 | B1 | 4/2001 | Williams | |
| 6,237,865 | B1 | 5/2001 | Luttermann et al. | |
| 7,506,461 | B2 * | 3/2009 | Jonninen | 37/403 |
| 2006/0242864 | A1 | 11/2006 | Jonninen | |

FOREIGN PATENT DOCUMENTS

| | | | |
|---|---|---|---|
| CA | 2 247 715 | A1 | 3/2000 |
| DE | 10064149 | A1 | 7/2002 |
| GB | 2 401 096 | A | 11/2004 |
| JP | 9-53252 | | 2/1997 |
| WO | WO 01/58595 | A1 | 8/2001 |
| WO | WO 2007/132065 | A1 | 11/2007 |

OTHER PUBLICATIONS

European Search Report for European Application No. EP 09 17 7867, mailed Mar. 30, 2010, 2 pgs.
Finnish Search Report for Finnish Application No. 20086249, dated Sep. 14, 2009, 2 pgs. (with translation).

* cited by examiner

*Primary Examiner* — Robert E Pezzuto
(74) *Attorney, Agent, or Firm* — Sterne, Kessler, Goldstein & Fox P.L.L.C.

(57) ABSTRACT

The invention relates to a screening, crushing or mixing bucket, which is formed into a bucket of an excavating machine or bucket loader, comprising a bottom plate (1), side walls (2) and at the back of the bucket working drums (3) rotatable about their shafts, which screen, crush or mix the material in the bucket as they rotate and at the same time deliver screened, crushed or mixed material out of the bucket, between or through the working drums (3). In the bucket are casings (4) for the power transmission and bearings of the working drums (3). The casings (4) are limited by frame plates (5) to which the bearing housings (6) of the working drums (3) are attachable. The frame plates (5) have receiving and fastening formings (5*a*, 5*b*) for the working drums (3), into which the drums (3) with their bearings (6) can be positioned through the rear side of the bucket. The sides of the casings (4) may in that case be smooth and their opening wall plates are on the rear side of the bucket.

6 Claims, 7 Drawing Sheets

SCREENING, CRUSHING OR MIXING BUCKET

BACKGROUND OF THE INVENTION

The invention relates to a screening, crushing or mixing bucket, which is formed into a bucket of an excavating machine or bucket loader, comprising a bottom plate, side walls and at the rear part of the bucket working drums rotatable about their shafts, which screen, crush or mix the material in the bucket as they rotate and at the same time deliver screened, crushed or mixed material out of the bucket between or through the working drums, and casings for the power transmission and bearings of the working drums, the said casings being limited by frame plates to which the bearing housings of the drums are attachable.

A bucket of this type is known from the Applicant's international patent application WO 0158595. In this known bucket, the casings for power transmission and the bearings are located outside the side walls of the bucket in order to prevent the arching problem of material flowing on the working drums. Buckets of similar type are also known, where the power transmission casings are located inside the bucket. Regardless of the location of the power transmission casings, they have to be made openable for servicing. In this case, the problem is that stones will stress the openable sides of the casings and their fixing screws which will no longer be openable after a period of use. Another problem with known buckets is that working drums have to be assembled of several parts during the installation stage in order to be able to install them into place.

BRIEF SUMMARY OF THE INVENTION

The aim of the invention is to provide a bucket of the above type, which does not have the above-mentioned problems.

This aim is achieved in accordance with the invention, in such a way that the frame plates have receiving and fastening formings for the working drums, into which the drums with their bearings can be positioned through the rear side of the bucket.

When the working drum with bearings is brought from behind and the bearing housings are fixed to the frame plates limiting the casing, the outer side walls can be made completely smooth and provided with wear-resistant plates. The working drums may, in addition, be built so as to be installed into place as a single entity.

BRIEF DESCRIPTION OF THE FIGURES

One example of the invention is described in greater detail in the following, with reference to accompanying drawings, in which.

DETAILED DESCRIPTION OF THE INVENTION

Figure 1:
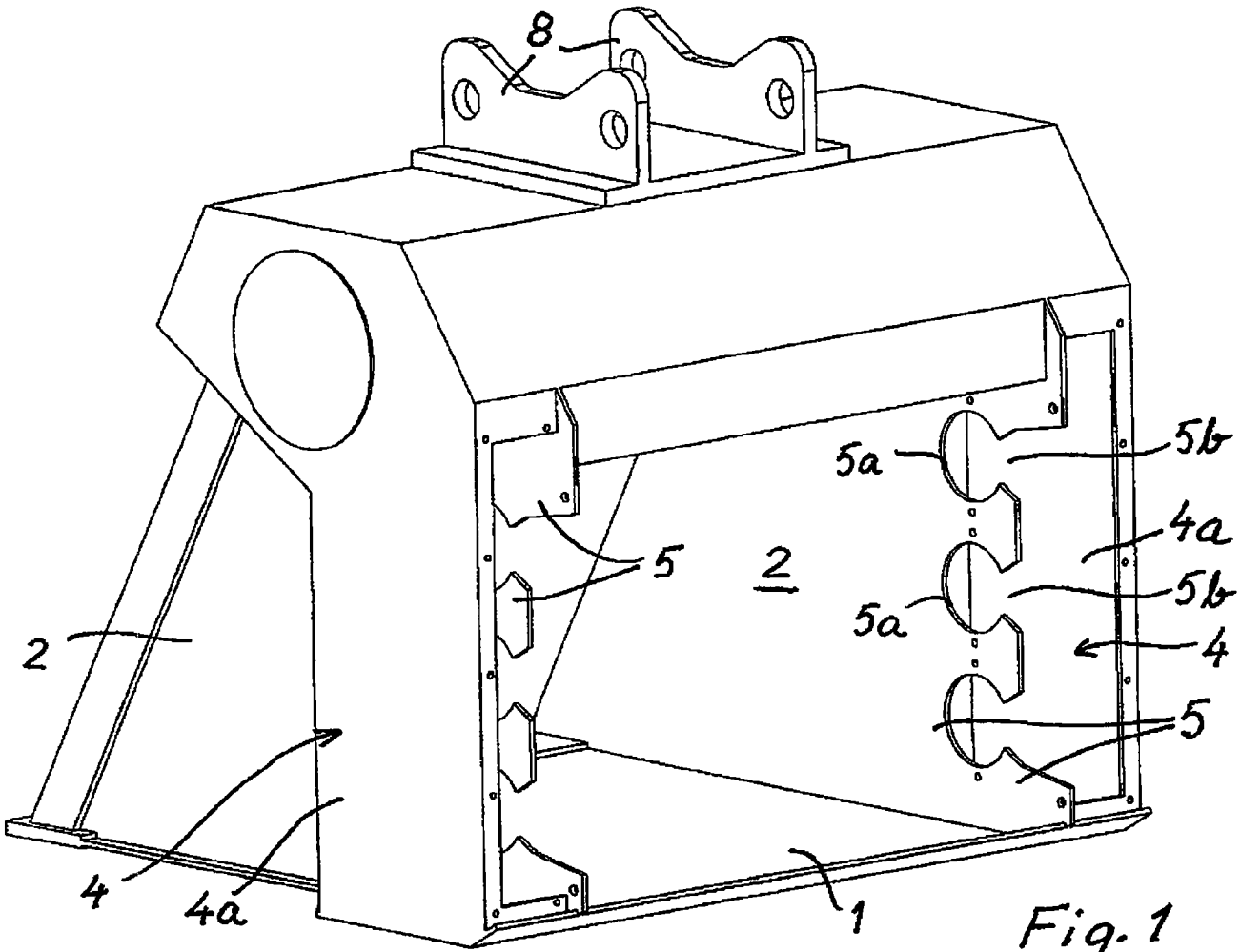
FIG. 1 shows a perspective view of the bucket according to the invention from behind, partly opened and without the working drums.
Figure 2:
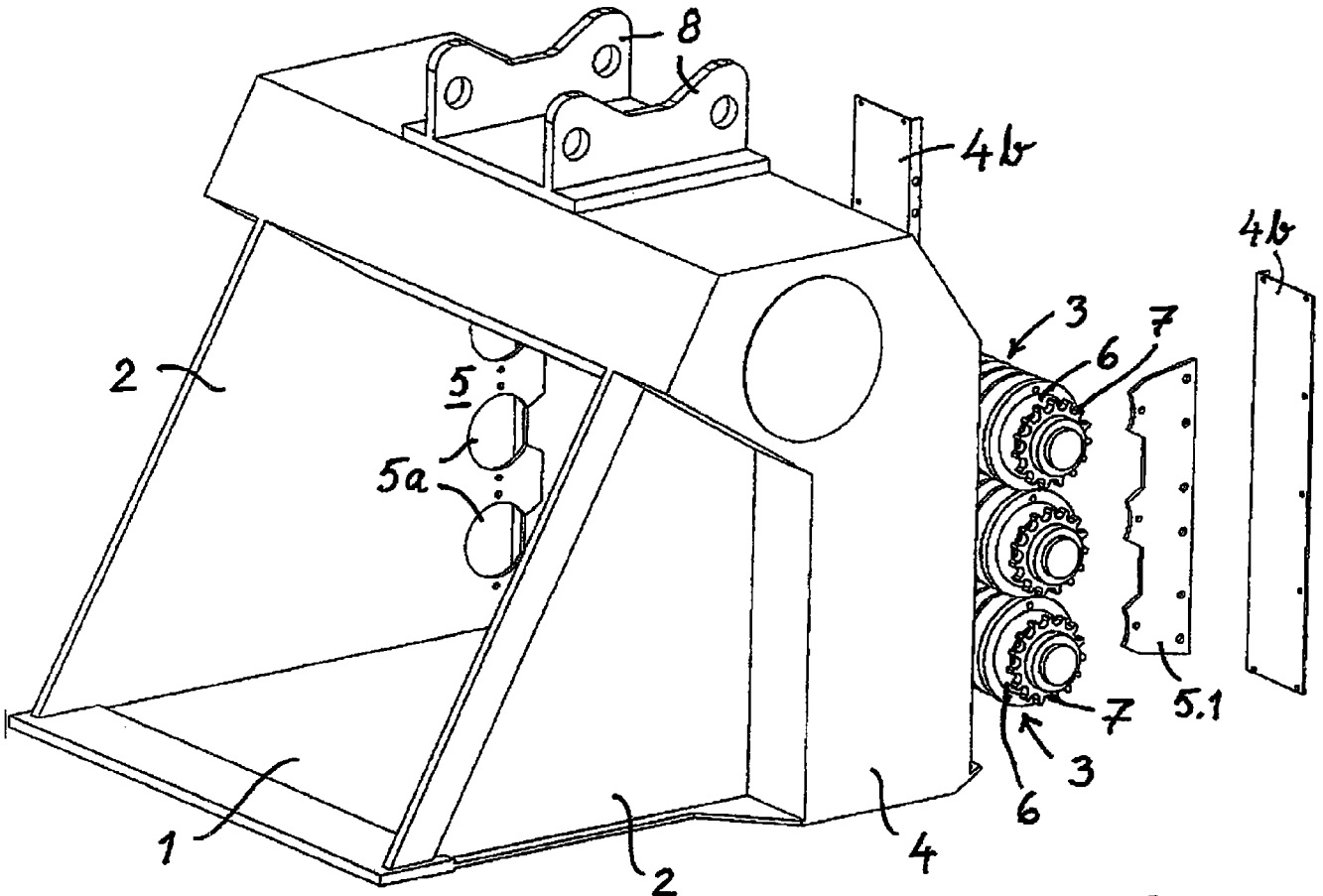
FIG. 2 shows a perspective view of the same bucket diagonally from the front with the working drums 3 detached from their places and the loose parts of the power transmission casings shown as an exploded view.
Figure 3:
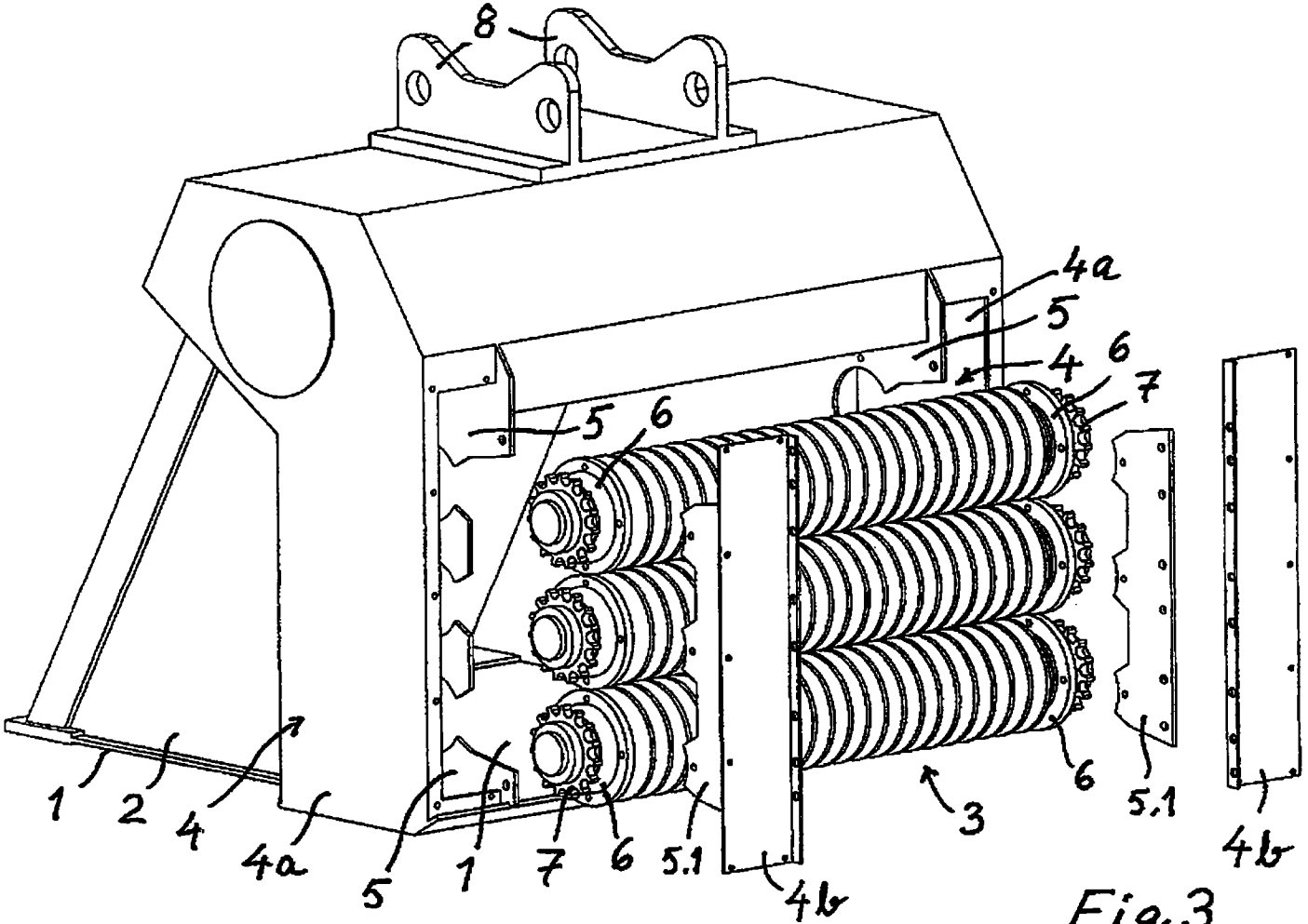
FIG. 3 shows the same as FIG. 2, as a perspective view diagonally from behind.
Figure 4:
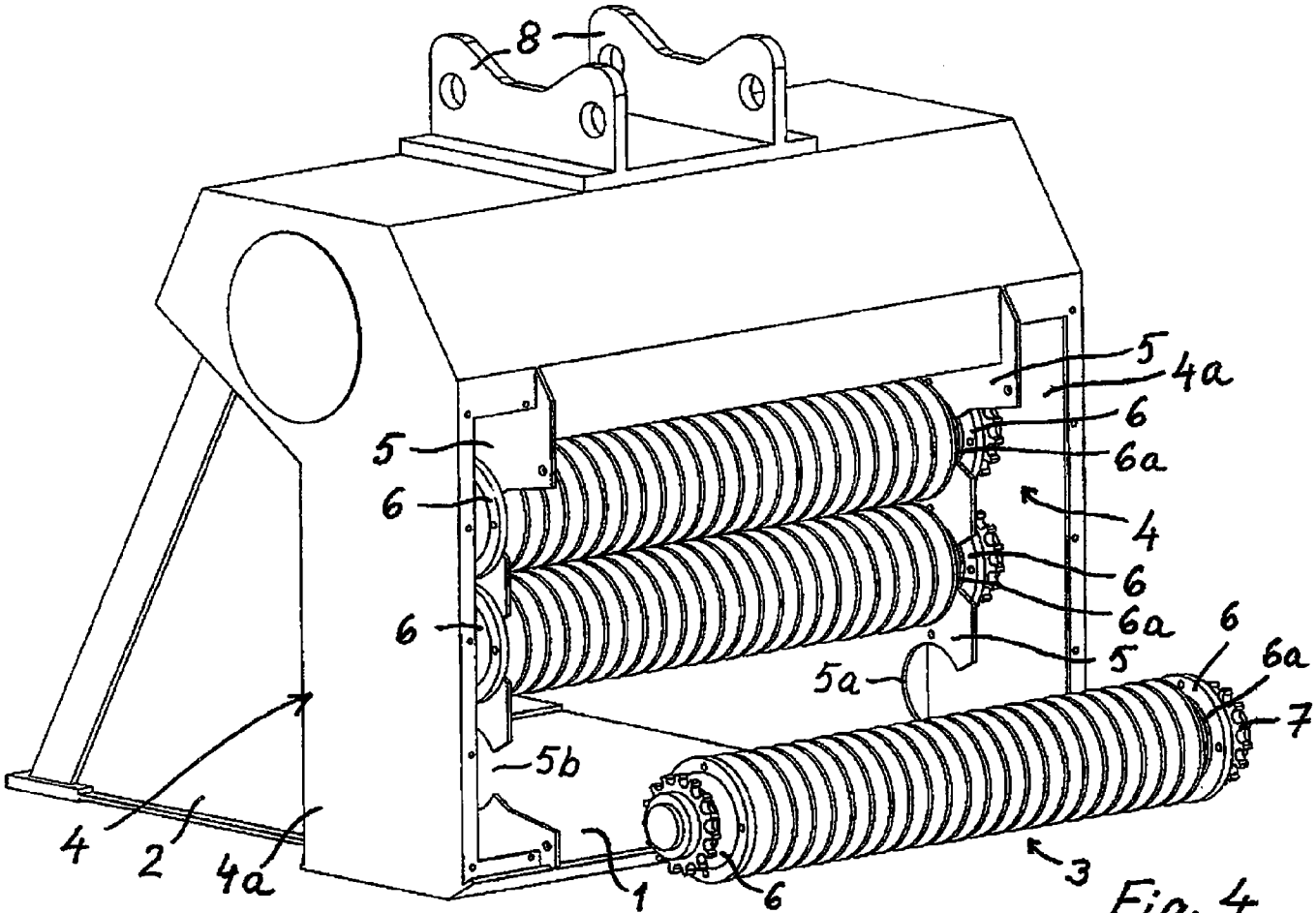
FIG. 4 shows the same bucket with the top two working drums 3 installed into place and the bottommost working drum 3 still unattached.
Figure 5:
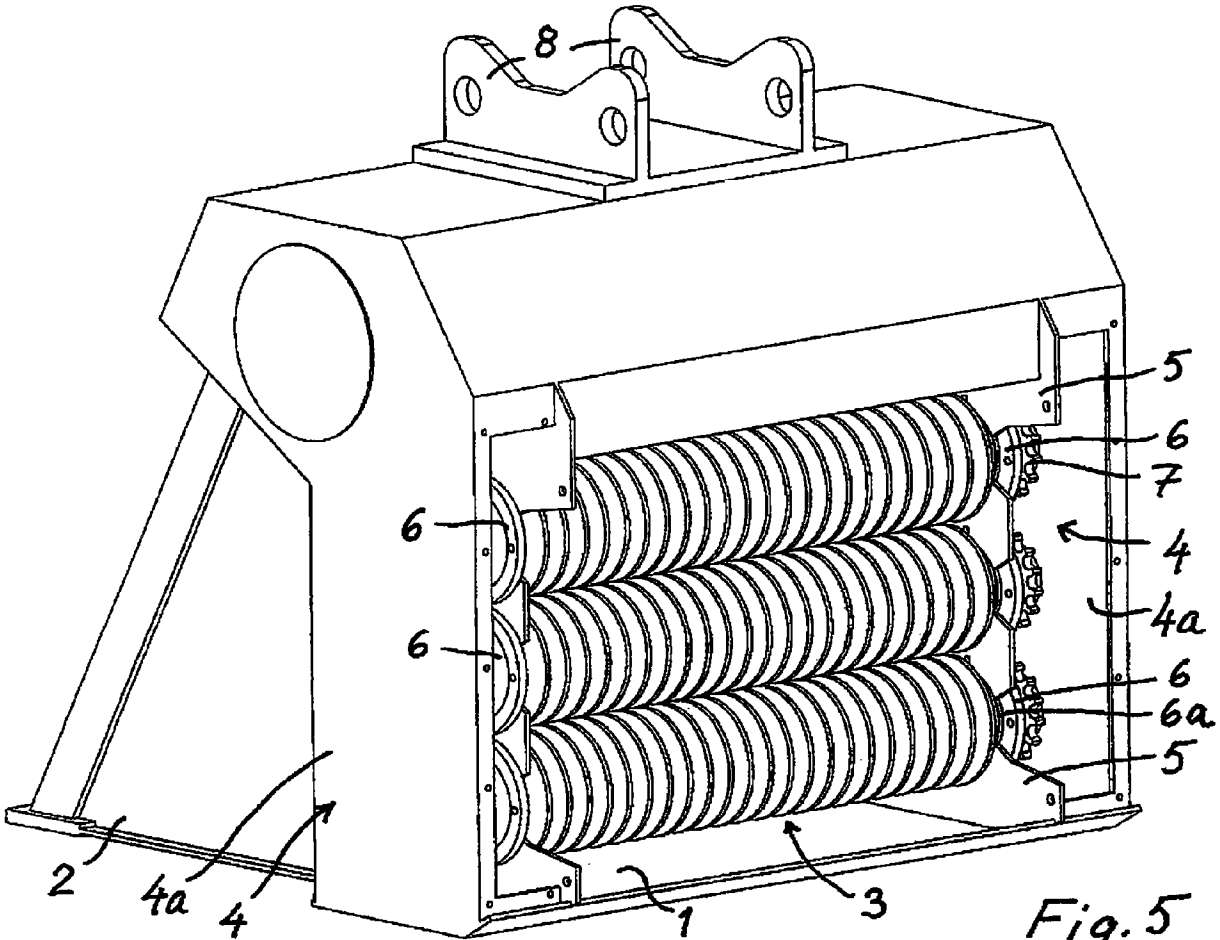
FIG. 5 shows the same bucket with all working drums 3 installed into place.
Figure 6:
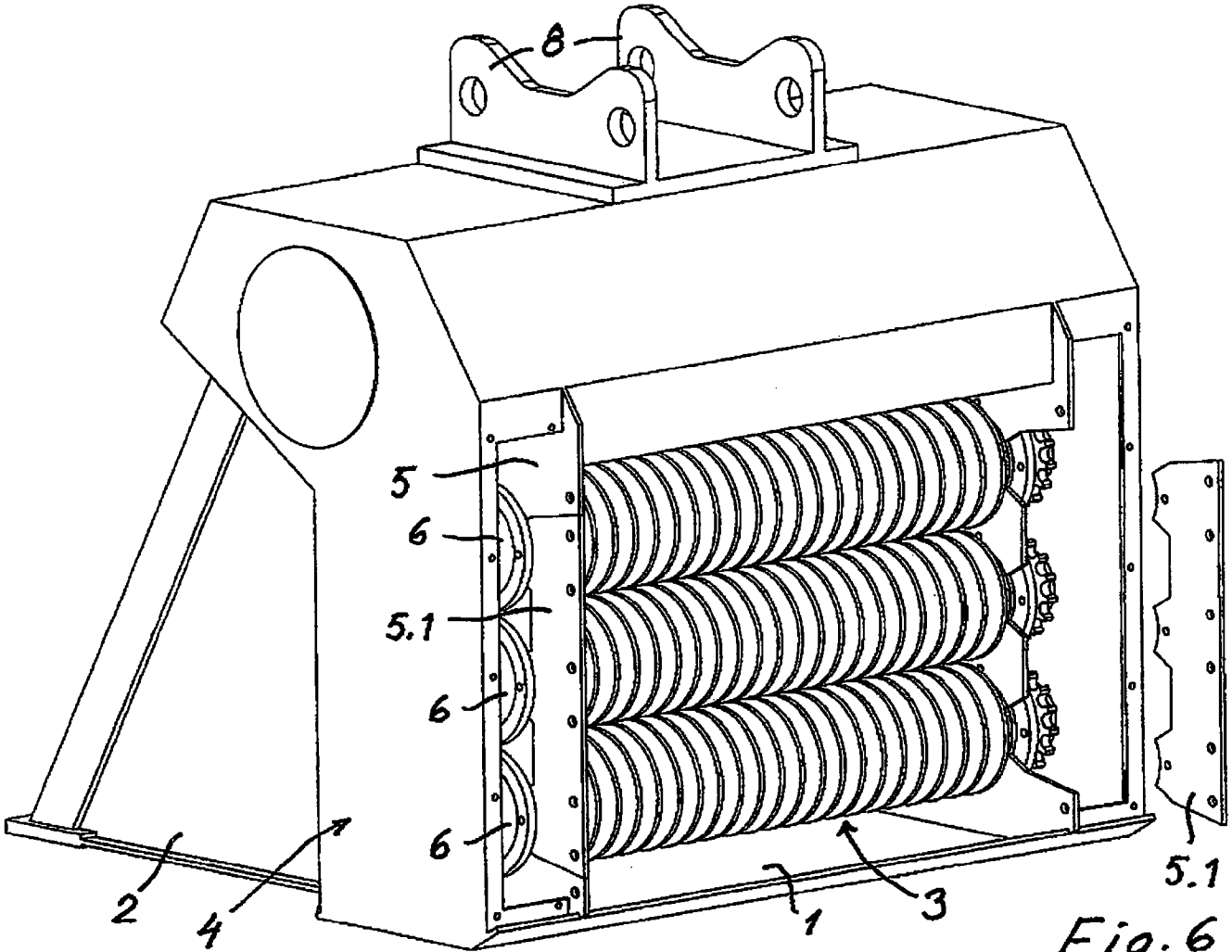
FIG. 6 shows the assembly stage following that of FIG. 5, where one of the complementary pieces 5.1. of the frame plates is attached into place.
Figure 7:
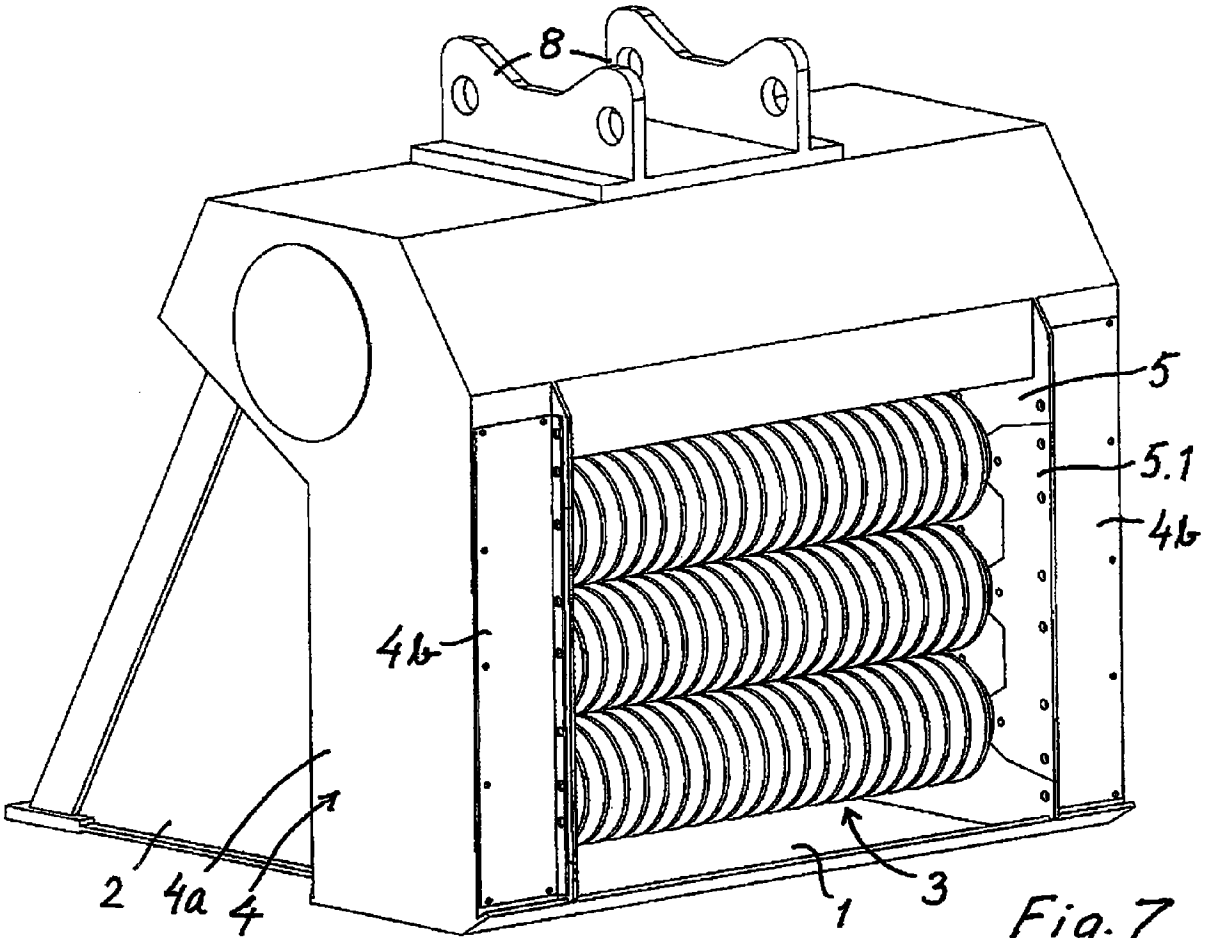
FIG. 7 shows the final assembly stage of the same bucket, where the back wall plates 4*b* of the casings 4 are fixed into place.

The bucket according to the invention can be fixed to be the bucket of an excavating machine or bucket loader, for which purpose there are fastening lugs 8 on the top side of the bucket.

The bucket comprises a bottom plate 1, side walls 2 and at the rear part of the bucket working drums 3 rotatable about their shafts, which screen, crush or mix the material in the bucket as they rotate and at the same time deliver screened, crushed or mixed material out of the bucket between or through the working drums. Between the flanges of the working drums 3 may be fixed different types of crushing teeth, which are not shown.

To the rear parts of the side walls 2 are attached casings 4 for power transmission and the bearings of the working drums 3. The casings 4 have external side walls 4*a* and in the embodiment shown, the casings 4 are separated from the interior of the bucket by frame plates 5, to which the bearing housings 6 of the working drums 3 are attachable. In the case shown, the frame plates 5 are a direct extension of the side walls 2 and of the same plate material as the side walls 2.

What is novel and special about the invention is the fact that the frame plates 5 comprise receiving and fastening formings 5*a*, 5*b* for the working drums 6, into which the working drums 3 with their bearings 6 can be positioned as a single entity through the rear side of the bucket.

The working drums 3 are horizontal in the operating position of the bucket. The frame plates 5 are between the external side walls 4*a* of the casings 4, at a distance from the external side walls 4*a*, whereupon chain wheel and bearing casings are formed between the frame plates 5 and the external side walls 4*a* of the casings.

The frame plates 5 are provided with backwards opening drum receiving openings 5*a*, the assembling slot 5*b* of which allows the drums to be brought into their positions, whereupon the bearings 6 and the drive gears 7 of the drums are positioned between the frame plates 5 and the external side plates 4*a* of the casings. A particularly strong attachment for the drums and their bearing housings is achieved by the bearing housings 6 being movable in the axial direction of the drums 3 towards one another into a form locking with the receiving openings 5*a* of the frame plates 5. For this purpose, there are low cylindrical projections in the bearing housings 6, the diameter of the said projections only just fitting in the round opening 5*a*. The attachment flange of the bearing housings, which surrounds the bearing housings, is fixed with screws or bolts to the frame plate 5.

To the rear parts of the frame plates 5 can be fixed complementary pieces 5.1, which limit the receiving openings 5*a* of the working drums in the frame plate and close the assembling slot 5*b* of the working drums to the receiving openings 5*a*. The chain wheel and bearing casings formed between the frame plates 5 and the external side walls 4*a* of the casings can be closed from behind by fixing detachable back wall plates 4*b* on the rear side of the bucket. Each of the back wall plates 4*b* is preferably fixed from one edge with bolts or screws both to the frame plate 5 and to the complementary piece 5.1, and from the other edge to the rear edge of the external side wall 4*a* of the casing. In this way, the exterior faces of the external side walls 4*a* of the casings 4 area maintained as smooth wearing plates, which do not need to be opened. The back wall plates 4*b* of the casings 4 are not subjected to substantial stress from stones when the bucket is in operation and thus it is possible to open them even after a long period of use.

What is claimed is:

1. A screening, crushing or mixing bucket of an excavating machine or bucket loader, comprising:

a bottom plate;

side walls;

working drums comprising shafts, wherein the working drums disposed at a back of the bucket are rotatable about the shafts, and wherein the working drums are configured to screen, crush or mix material in the bucket as the working drums rotate and at the same time deliver screened, crushed or mixed material out of the bucket, between or through the working drums; and casings for a power transmission and bearings of the working drums, the casings being limited by frame plates to which bearing housings of the working drums are attachable, wherein:

the frame plates are between external side walls of the casings, the frame plates have receiving and fastening formings for the working drums at a distance from the external side walls, and the receiving and fastening formings include backwards opening working drum receiving openings into which the working drums with the bearings can be positioned through a rear side of the bucket.

2. The bucket as claimed in claim 1, wherein the working drums are horizontal in the operating position, extensions of the side walls of the bucket form the frame plates, and the bearings and drive gears of the working drums are located between the frame plates and the external side walls of the casings.

3. The bucket as claimed in claim 1, wherein the bearing housings are movable in an axial direction of the drums towards one another into a form locking with the receiving openings of the frame plates.

4. The bucket as claimed in claim 1, wherein complementary pieces are fixed to rear parts of the frame plates, which limit the receiving openings of the working drums in the frame plate and close an assembling slot of the working drums to the receiving openings.

5. The bucket as claimed in claim 1, wherein a chain wheel and the bearing casings formed between the frame plates and the external side walls of the casings are closed by means of back wall plates fixed detachably on the rear side of the bucket.

6. The bucket as claimed in claim 5, wherein each of the back wall plates is fixed from one edge with bolts or screws both to the frame plate and to a complementary piece, and from another edge to a rear edge of the external side wall of the casing, thus leaving exterior faces of the external side walls of the casings smooth.

* * * * *